US005367995A

United States Patent [19]

Kondo

[11] Patent Number: 5,367,995

[45] Date of Patent: Nov. 29, 1994

[54] STARTING MECHANISM OF AN ENGINE FOR A MODEL

[75] Inventor: Hirotoshi Kondo, Tokyo, Japan

[73] Assignee: Yoshio Kondo, Tokyo, Japan

[21] Appl. No.: 91,763

[22] Filed: Jul. 14, 1993

[30] Foreign Application Priority Data

Oct. 7, 1992 [JP] Japan ..... 4-075418[U]

[51] Int. Cl.[5] ..... F02N 11/14; F02P 19/02

[52] U.S. Cl. ..... 123/179.6; 123/DIG. 3

[58] Field of Search ..... 123/179.6, DIG. 3, 179.27, 123/179.25, 179.26, 179.21, 279.2

[56] References Cited

U.S. PATENT DOCUMENTS 4,183,341 1/1980 Eastman ..... 123/DIG. 3
4,653,444 3/1987 Brockbank et al. ..... 123/179.27
5,095,865 3/1992 Keister ..... 123/DIG. 3

*Primary Examiner*—Andrew M. Dolinar
*Attorney, Agent, or Firm*—Dilworth & Barrese

[57] ABSTRACT

The present invention discloses an improved starting mechanism for starting an engine of a model such as a model airplane, a model car, a model helicopter or a model ship, etc. A starting mechanism for starting an engine for a model comprises electric wires as power source connecting part for starting a motor and heating a plug being gathered at one connector, a corresponding connector capable of connecting to said connector being separately mounted, electric wires led from one power source being gathered at the corresponding connector, a hand switch and a plug heating circuit being provided at a suitable position of the electric wires, and the plug heating circuit for heating the plug a little later than the starting time of the starting motor.

4 Claims, 4 Drawing Sheets

STARTING MECHANISM OF AN ENGINE FOR A MODEL

BACKGROUND OF THE INVENTION

The present invention relates to a starting mechanism of an engine for a model, and more particularly relates to an improved starting mechanism of an engine for various models such as a model airplane, a model car, a model helicopter or a model ship etc.

Hitherto, as a conventional method of starting an engine of various models as above, for example, firstly a starting method of an engine by revolving a fly wheel by hand and secondarily a starting method by means of a starting motor were employed.

However, all the aforementioned conventional methods have such inconveniences that according to the first method by revolving a fly wheel by hand a plug heating power source (1.5 V in general ) is necessary. Further, said method cannot be easily carried out because accumlated experience is required to revolve the fly wheel. Further according to the secondary method above, on the other hand, a starting power source( 12 V in general) of a starting motor and a plug heating power source are necessary, resulting in excess equipment.

SUMMARY OF THE INVENTION

With the above in mind, an object of the present invention is to provide an improved starting mechanism of an engine for a model wherein the power source connecting parts for starting a motor and heating a plug are gathered at one connector so as to start an engine easily by ON or OFF operation of a switch, etc., by an external power source through said connector, thereby settling the aforementioned inconveniences.

The above object of the present invention can be achieved by providing a starting mechanism of an engine for a model according to the present invention comprising the electric wires as power source connecting parts for starting a motor and heating a plug being gathered at one connector, a corresponding connector capable of connecting to said connector being separately mounted, electric wires led from one power source being gathered at said corresponding connector, a hand switch and a plug heating circuit being provided at a suitable position of said electric wires, and the plug heating circuit for heating the plug a little later than the starting time of said starting motor.

According to the starting mechanism of an engine for a model of the present invention, it is possible to start an engine with ease only by ON or OFF operation of a hand switch directly or through an operation under wireless control. Further, it is possible to prevent the occurrence of the so-called "engine stop" on the way of starting the engine. Still furthermore, equipment necessary for the starting mechanism of an engine according to the present invention may be concise because one power source for starting a motor and for heating a plug is used in common.

DESCRIPTION OF THE PREFERRED EMBODIMENTS

Hereinafter, embodiments according to the present invention will be described in detail with reference to the drawings.

Figure 1:
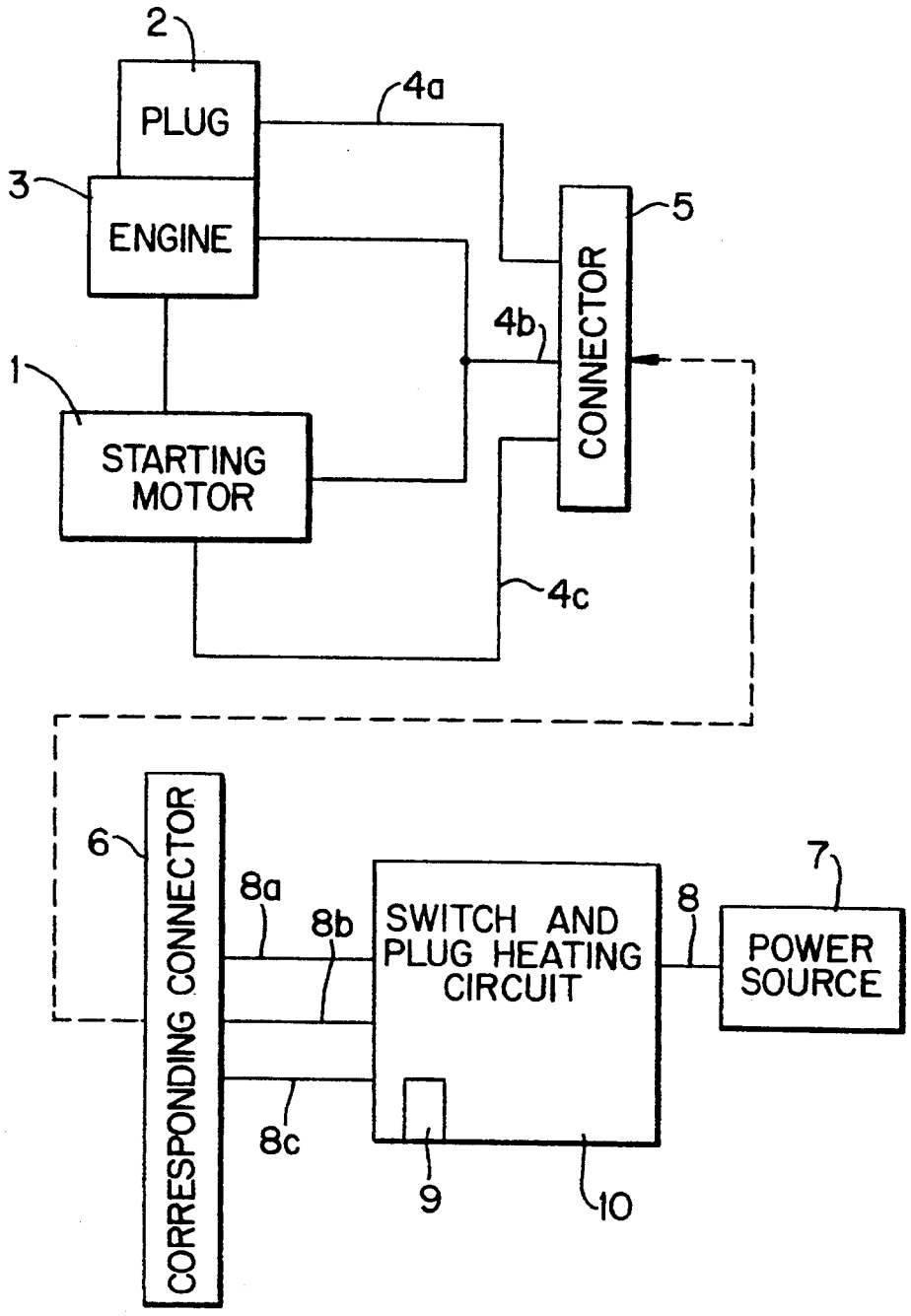
FIG. 1 is a block diagram of a starting mechanism of an engine for a model according to the present invention.

FIG. 1 is a block diagram of a starting mechanism of an engine for a model according to the present invention.

A starting motor 1 and a plug 2 are arranged at the circumference of an engine 3 as illustrated in FIG. 1. Electric wires 4*a*,4*b*,4*c* as power source connecting parts for each of the above constitutional elements are gathered at a connector 5. The other electric wires 8,8*a*, 8*b*,8*c* led from a power source 7 composed of Ni-Cd battery etc., are gathered at a corresponding connector 6 which is capable of connecting to said connector 5.

A hand switch 9 and a plug heating circuit 10 are mounted at a suitable position of the electric wires 8,8*a*, 8*b*,8*c*.

According to the starting mechanism of the present invention, it is possible to heat up the plug 2 a little later than the starting time of the starting motor 1. Therefore an overshoot current may be small at the time of a switch ON, thereby reducing the capacity of the power source 7.

Figure 2A:
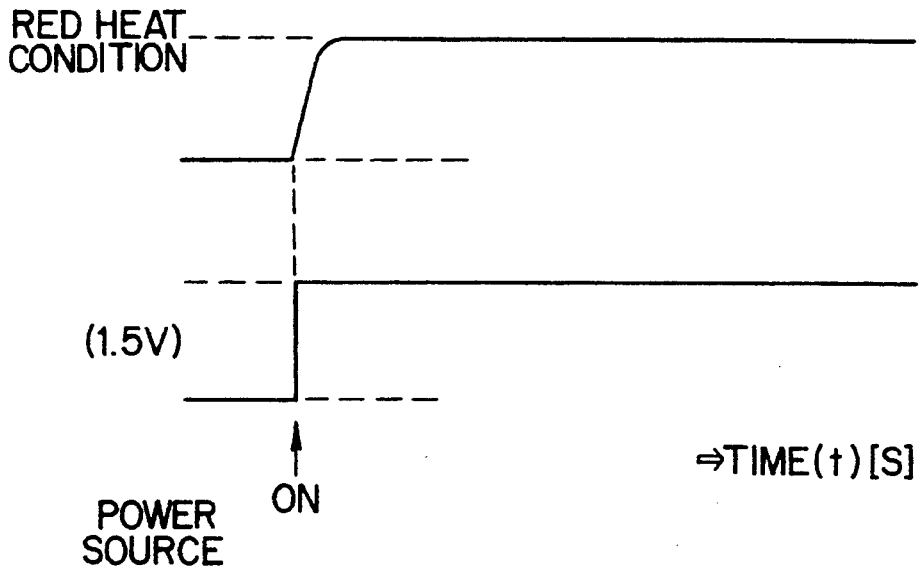
FIG. 2A and 2B are waveform diagrams of first examples according to the present invention.

Following is a definite means to heat the plug 2 a little later than the starting time of a starting motor.

a) Method of delaying the timing to heat a plug by good use of the characteristic of a plug:

A power source for heating a plug is prepared in the state of a pulse without preparing the same in the state of a direct current. Thus, there may be about 0.5–1 seconds delay until the plug reaches the state of red heat completely due to the inductance property and electricity-heat transfer of the plug (FIG. 2A).

Figure 2B:
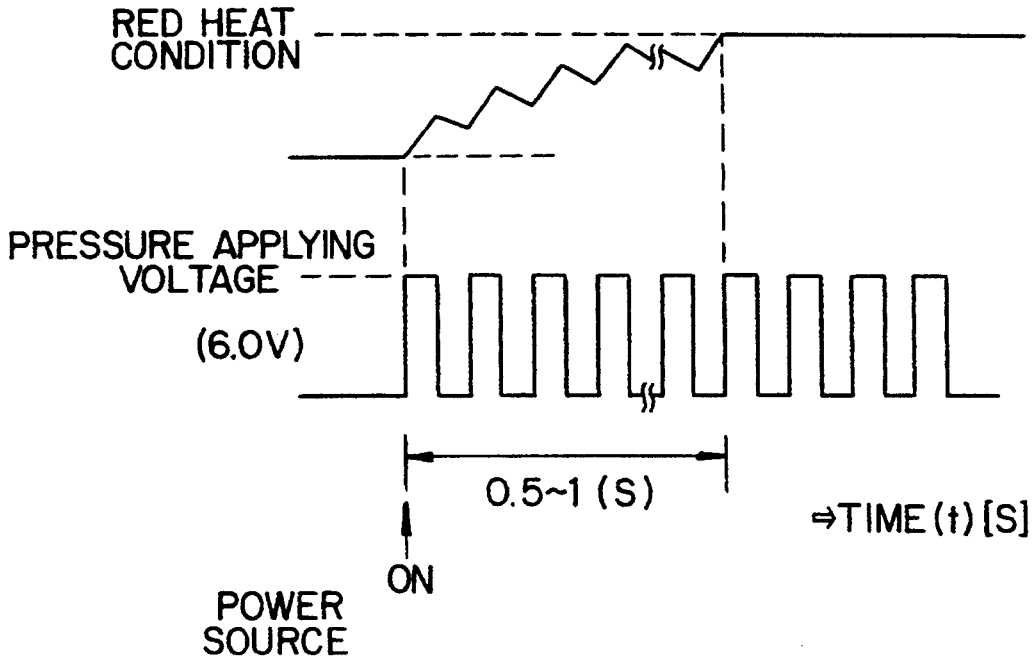
Figure 3:
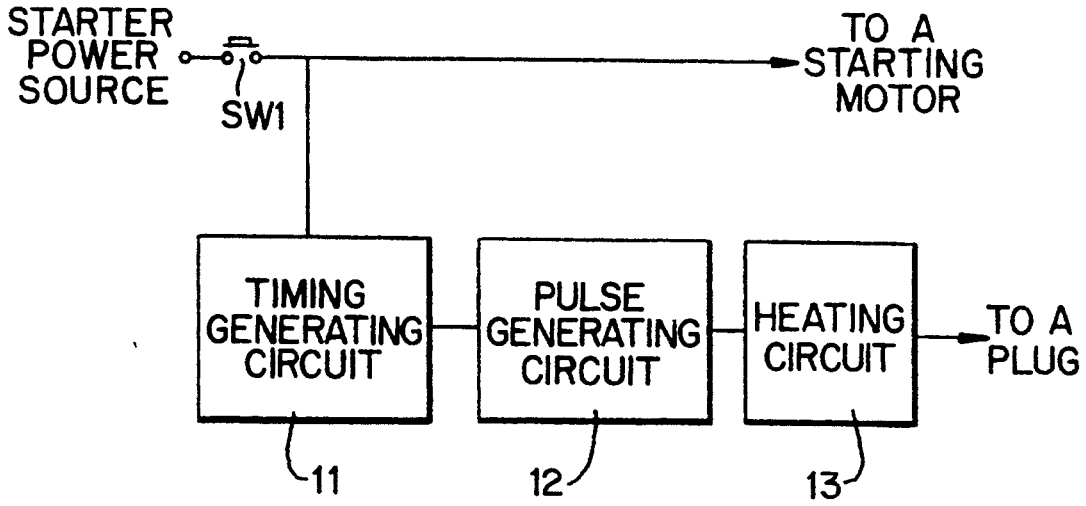
FIG. 3 is a circuit diagram of a second example according to the present invention.
Figure 4:
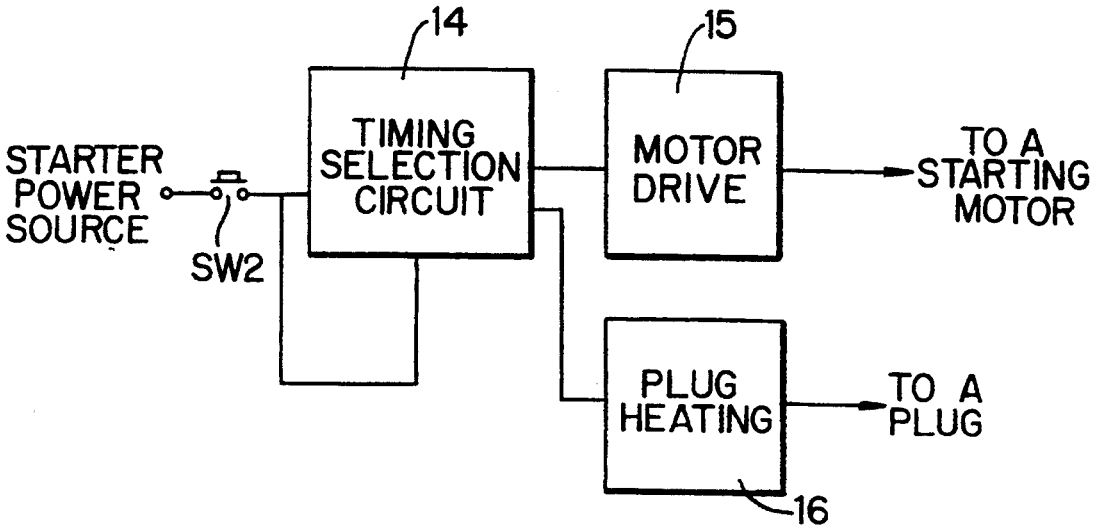
FIG. 4 is a circuit diagram of a third example of the present invention.

Furthermore, it is also preferable to prepare a power source for heating a plug in the state of a pulse in order to reduce the voltage of the power source 7 for starting the motor 1 to the voltage for heating the plug, which serves a double purpose (FIG. 2B).

b) Method of delaying the timing electrically for heating the plug (FIG. 3):

The starting motor 1 revolves by turning a switch(SW1) on. At the same time, a pulse generating circuit 12 is actuated by means of a timing generating circuit 11 after lapse of an optionally prescribed time so as to heat a plug by driving a primary side of a power source by means of a heating circuit 13. By making good use of the timing for heating the plug, fuel choke etc., may be carried out.

c) Method of delaying the timing electrically for heating a plug by selecting heating of the starting motor 1 or the plug 2. (FIG. 4):

Motor driving 15 or plug heating 16 selected by a timing selection circuit 14 may be delayed by turning a switch(SW2) on. The plug heating 16 or motor driving 15 which is not selected by means of the timing selection circuit 14 may be actuated without delay.

Figure 5:
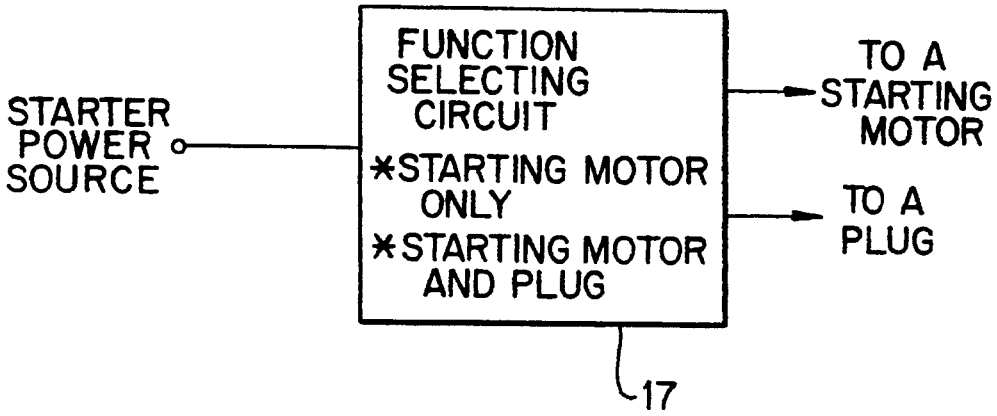
FIG. 5 is a circuit diagram of a fourth example according to the present invention.

Thus, when the plug heating 16 is selected by means of the timing selection circuit 14, the effect as described in item b) above (FIG. 3) can be obtained and on the other hand when the motor driving 15 is selected, it is possible to reduce over choke etc., of fuel.

d) Method of delaying the timing for heating a plug by selecting either the starting motor 1 or the starting motor and the plug 2. (FIG. 5)

When a starting motor side is selected by means of a function selecting circuit 17, the starting motor 1 only revolves, thereby carrying out fuel choke etc.

When the starting motor and plug sides are selected by means of a function selecting circuit 17, the starting motor 1 and the plug 2 are actuated and the starting motor starts to revolve. Almost at the same time, 0.5–1 seconds later, the plug 2 in the shape of a nicrome wire becomes red hot.

Furthermore, it is possible that the starting motor, the plug and one connector are mounted at the body of a model together with the engine and further the corresponding connector, one power source and electric wires providing with the hand switch and the plug heating circuit are mounted at the outside of the body of a model.

Still furthermore, it is also possible to mount all the constitutional elements at the body of a model together with the engine for a model.

According to the starting mechanism of an engine for a model of the present invention, wherein the power source for starting a motor and heating a plug has common use, mechanical equipment becomes light and simple, resulting in low cost and easy operation. Furthermore, since the so-called "engine stop" will hardly occur, it becomes easy to start an engine for a model.

What is claimed is:

1. A starting mechanism for starting an engine for a model comprising electric wires as power source connecting parts for starting a motor and heating a plug being gathered at one connector, a corresponding connector capable of connecting to said connector being separately mounted, electric wires led from one power source being gathered at said corresponding connector, a hand switch and a plug heating circuit being provided at a suitable position of said electric wires, and the plug heating circuit for heating the plug a little later than the starting time of the starting motor or almost at the same time as the motor starting time.

2. The starting mechanism for starting an engine for a model according to claim 1, wherein the starting motor, the plug and one connector and the engine for a model are mounted at the body of a model and further the corresponding connector,one power source and the electric wires providing with the hand switch and the plug heating circuit are mounted at the outside of the body of a model.

3. A starting mechanism for starting an engine for a model comprising electric wires as power source connecting parts for starting a motor and heating a plug being gathered at one connector, a corresponding connector capable of connecting to said connector, electric wires led from one power source being gathered at said corresponding connector, a hand switch and a plug heating circuit being provided at a suitable position of said electric wires, the plug heating circuit for heating the plug a little later than the starting time of the starting motor or almost at the same time as the motor starting time, and wherein all the constitutional elements together with the engine are mounted at the body of a model.

4. The starting mechanism for starting an engine for a model according to claim 3, wherein the constitutional elements include the starting motor, plug, connectors, power source and electric wires all being mounted at the body of a model together with the engine.

* * * * *